US006295438B1

(12) United States Patent
Fujishiro et al.

(10) Patent No.: US 6,295,438 B1
(45) Date of Patent: Sep. 25, 2001

(54) METHOD AND APPARATUS FOR FORMING AN IMAGE CAPABLE OF SUPPLYING A PROPER AMOUNT OF A LUBRICANT TO EACH IMAGE FORMING SECTION

(75) Inventors: Takatsugu Fujishiro, Tokyo; Nobuhiko Umezawa, Kanagawa; Nobuto Yokokawa, Saitama; Atsushi Takehara; Masayuki Ueda, both of Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/619,739

(22) Filed: Jul. 19, 2000

(30) Foreign Application Priority Data

Jul. 19, 1999 (JP) ..... 11-204512

(51) Int. Cl.[7] ..... G03G 21/00; G03G 15/01
(52) U.S. Cl. ..... 399/346; 399/299; 399/349
(58) Field of Search ..... 399/346, 299, 399/298, 343, 349, 353; 430/125

(56) References Cited

U.S. PATENT DOCUMENTS

| | | | |
|---|---|---|---|
| 5,606,408 | 2/1997 | Yano et al. | 399/343 |
| 5,619,316 | 4/1997 | Shoji et al. | 399/359 |
| 5,638,159 | 6/1997 | Kai et al. | 399/253 |
| 5,797,063 | 8/1998 | Umezawa et al. | 399/34 |
| 5,812,919 * | 9/1998 | Takano et al. | 399/346 X |
| 6,060,205 | 5/2000 | Takeichi et al. | 399/346 X |

FOREIGN PATENT DOCUMENTS

| | | |
|---|---|---|
| 06175453 | 6/1994 | (JP) . |
| 06324603 | 11/1994 | (JP) . |
| 08305236 | 11/1996 | (JP) . |
| 09054531 | 2/1997 | (JP) . |
| 09062163 | 3/1997 | (JP) . |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus including a plurality of image forming sections each having an electrostatic latent image bearing member to form a latent image on its surface, a charging device to uniformly charge the electrostatic latent image bearing member, a developing device to develop the electrostatic latent image formed on the electrostatic latent image bearing member into a visible image and a cleaning device to remove developer adhered to the electrostatic latent image bearing member. The image forming sections are disposed in series in close proximity to or contacting a transfer sheet conveying belt spanned rotatively and are configured to differentiate an amount of a lubricant to be supplied to the surface of each electrostatic latent image bearing member such that at least one image forming section is differentiated from other image forming sections.

14 Claims, 12 Drawing Sheets

METHOD AND APPARATUS FOR FORMING AN IMAGE CAPABLE OF SUPPLYING A PROPER AMOUNT OF A LUBRICANT TO EACH IMAGE FORMING SECTION

BACKGROUND OF THE INVENTION

1. Field of the Invention

The present invention relates to an image forming apparatus, such as a copying machine, a facsimile, a printer, etc., and more particularly to an image forming apparatus capable of preventing a lifetime of an electrostatic latent image bearing member from being decreased by friction with an appropriate supply of a lubricant to the electrostatic latent image bearing member such as a photoconductive element.

2. Discussion of the Background

In an electrophotographic image forming apparatus, such as a copying machine, a facsimile, a printer, etc., such an image forming apparatus is well known that includes an image forming section having an electrostatic latent image bearing member to form an electrostatic latent image on its surface, a charging device to uniformly charge the electrostatic latent image bearing member, a developing device to develop the electrostatic latent image formed on the surface of the electrostatic latent image bearing member into a visible image and a cleaning device to remove developer adhered to the electrostatic latent image bearing member.

FIG. 9 is a schematic drawing illustrating an exemplary construction of an image forming section 1 in an electrophotographic image forming apparatus in the art. A part having the reference numeral of 10 in FIG. 9 is a photoconductive element, for example an electrostatic latent image bearing member, and a surface of the photoconductive element 10 is uniformly charged by a charging roller 11. A desired electrostatic latent image is formed on the surface of the charged photoconductive element 10 with an exposure light 12 irradiated from an optical writing device (not shown). The electrostatic latent image is then developed into a visible toner image with toner in a developing device 13. The toner image formed on the surface of the photoconductive element 10 is transferred onto a transfer sheet carried on a transfer sheet conveying belt 14 with a transfer bias applied by a transfer brush 15. The transfer sheet having the transferred toner image is conveyed to a fixing device (not shown) where the toner image is fixed onto the transfer sheet by being heated and pressed. A part having the reference numeral of 16 is a cleaning device including a cleaning blade 17. The cleaning device 16 is provided so as to remove residual toner remaining on the surface of the photoconductive element 10 with the cleaning blade 17. The removed toner is conveyed to a used toner container (not shown) by a used toner conveying screw 19. Further, a cleaning brush roller 18, which is a cleaning support member, to roil and remove toner on the surface of the photoconductive element is disposed at an upstream side of the cleaning blade 17 in the moving direction of the photoconductive element.

An image forming apparatus illustrated in FIG. 10 includes four image forming sections. Each of which has the same construction as that illustrated in FIG. 9 and is located in parallel to form images of different colors. The image forming apparatus also includes a transfer sheet conveying belt 14 to convey a transfer sheet to the four image forming sections 1B, 1C, 1M and 1Y. Reference numerals 12Y, 12C, 12M and 12B represent exposure light irradiated in the four image forming sections 1Y, 1C, 1M and 1B respectively. In the back surface side of the transfer sheet conveying belt 14, transfer brushes 15B, 15C, 15M and 15Y, which transfer a toner image formed at each image forming section 1B, 1C, 1M and 1Y, are provided opposing to the respective photoconductive elements 10B, 10C, 10M and 10Y so as to transfer the toner image formed at each image forming section 1B, 1C, 1M and 1Y onto a transfer sheet carried on the transfer sheet conveying belt 14 one after another superimposing each color toner image on each other. In an image forming apparatus illustrated in FIG. 10, a desired full color image can be obtained when each color of toner; black (B), cyan (C), magenta (M) and yellow (Y) is used at respective developing devices 13B, 13C, 13M and 13Y of the image forming sections 1B, 1C, 1M and 1Y. Such an image forming apparatus as described above is commonly known as a tandem color image forming apparatus.

A technology is widely known which suppresses an abrasion of a surface of a photoconductive element caused by a cleaning blade, etc., by supplying the photoconductive element with a lubricant and thereby preventing a lifetime of the photoconductive element from being decreased due to the abrasion, and various systems for supplying a lubricant are proposed. Two systems are known to supply a lubricant. A first type supplies the lubricant by pressing it directly against a surface of a photoconductive element (for example, in Japanese Patent Laid-Open Publication No. 9-62163). A second type supplies the lubricant by abutting a rotatable brush roller on the photoconductive element while abutting the lubricant on the rotatable brush roller (for example, in Japanese Patent Laid-Open Publication No. 6-324603). In the latter system, since a cleaning device to remove residual toner remaining on the surface of the photoconductive element is often configured to include a cleaning brush roller, such a system has been proposed that utilizes the cleaning brush roller as the above-described brush roller.

A plurality of image forming sections in the above-described tandem image forming apparatus are configured to have the same structure as to each other. However, a supply of a lubricant to a photoconductive element has to be adjusted to a proper amount in each image forming section.

An electrical action for a lubricant in a transfer section will now be discussed. Fluorine-containing resins polytetrafluoroethylene (four fluoridation ethylene resin) and PVDF (polyvinylidene fluoride) used as a lubricant electrically have negative characteristics. In a reverse development that uses negatively charged toner, positive bias is applied to a transfer section. Consequently, a force is exerted that electrically removes the lubricant adhered to a photoconductive element.

FIG. 11 explains a change in an amount of a removed lubricant over a lapse of time according to a different voltage level of a transfer bias. In this explanation, a coefficient of friction on a photoconductive element is measured as substitutive characteristics of an amount of a lubricant on a surface of the photoconductive element. It is observed that the higher a voltage of the transfer bias to be supplied, the larger the amount of the lubricant is removed when the apparatus is operated by varying the voltage level of the transfer bias with using a photoconductive element possessing a nearly constant coefficient of friction.

In the above-described tandem color image forming apparatus having four image forming sections, a technology is commonly known in which a smooth transfer is achieved by intensifying a transfer bias to be applied to an image forming section in order of image forming section from an upstream to a downstream in a moving direction of a transfer sheet conveying direction. In the configuration that intensifies the transfer bias in order of the image forming section from the upstream to the downstream, a lubricant will be easier to be removed from a surface of a photoconductive element in order of the image forming section from the upstream to the downstream, and an application of a lubricant to increase a lifetime of a photoconductive element will become less effective.

A proper amount of a lubricant must be supplied so as not to be inconvenienced by a mixture of a foreign substance due to an accumulated lubricant on a surface of a photoconductive element. It is preferable that the lubricant on the surface of the photoconductive element is removed completely before the next supply of lubricant is made after the lubricant has been supplied so that a fresh lubricant layer is always formed on the surface of the photoconductive element.

Further, when a mechanical condition in each image forming section is to be differentiated, it is advantageous from the view point of cost effectiveness to achieve the differentiation with minimum replacement parts while maintaining a maximum commonality of parts.

SUMMARY OF THE INVENTION

The present invention has been made in view of the above-discussed and other problems, and addresses the above-discussed and other problems.

The present invention advantageously provides a novel image forming apparatus supplying a proper amount of a lubricant to a surface of each photoconductive element to increase a lifetime of the photoconductive element without being inconvenienced by an oversupply of lubricant.

According to an embodiment of the present invention, an image forming apparatus includes a plurality of image forming sections having an electrostatic latent image bearing member to form a latent image on its surface, a charging device to uniformly charge the electrostatic latent image bearing member, a developing device to develop the electrostatic latent image formed on the electrostatic latent image bearing member into a visible image and a cleaning device to remove developer adhered to the electrostatic latent image bearing member. The image forming sections are disposed side by side in a line in close proximity to or contacting a transfer sheet conveying belt spanned rotatively. An amount of a lubricant to be supplied to the surface of the each electrostatic latent image bearing member is set such that at least one of the plurality of the image forming sections is differentiated from other of the plurality of the image forming sections.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
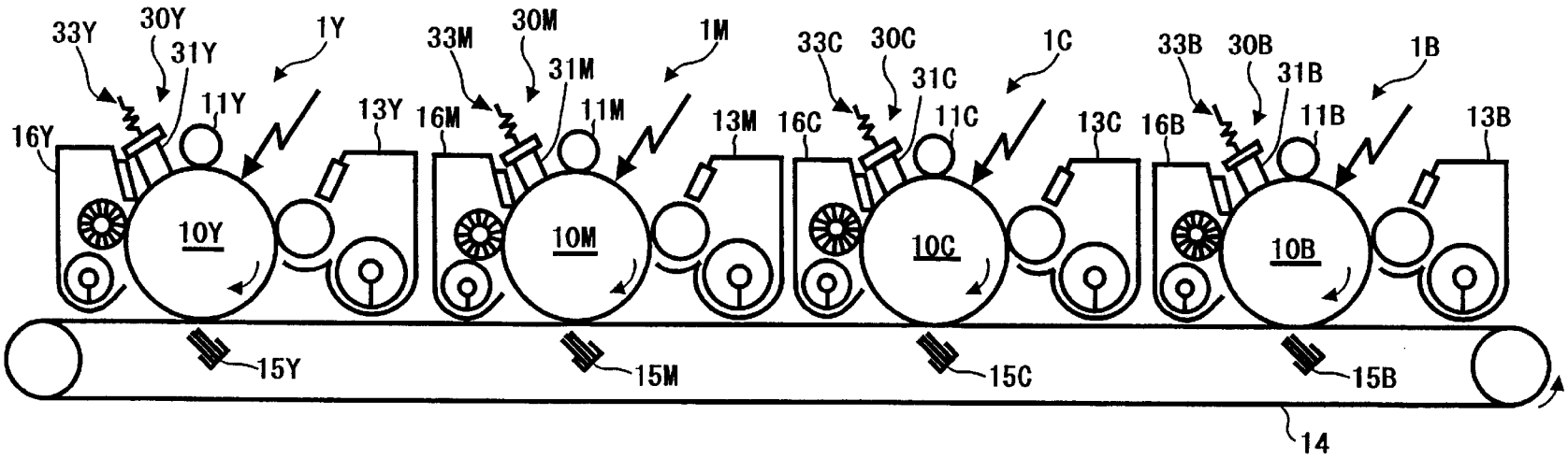
FIG. 1A is a schematic drawing illustrating a color image forming apparatus.
Figure 1B:
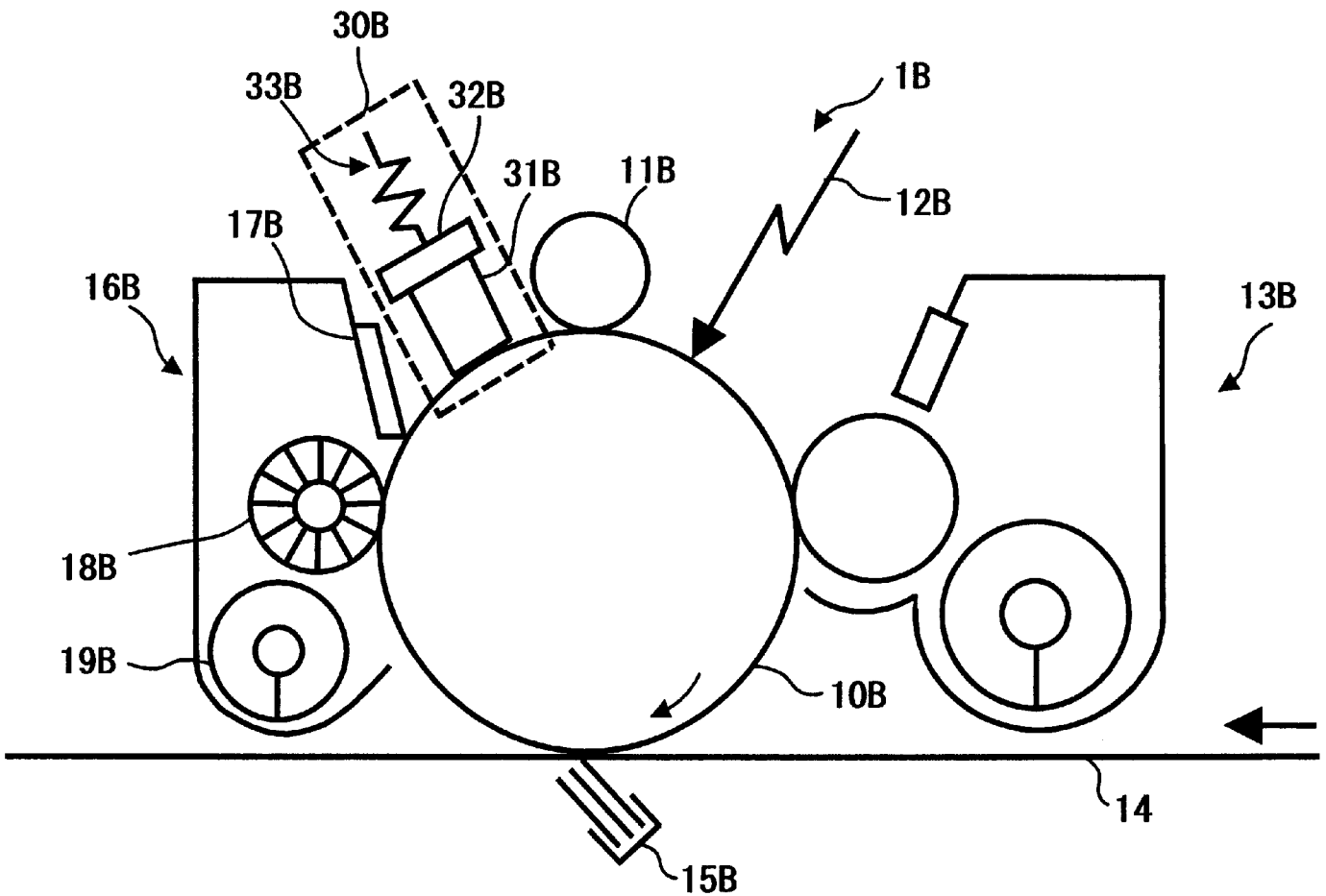
FIG. 1B is a schematic drawing illustrating one of the image forming sections of the color image forming apparatus in FIG. 1A.

Referring now to the drawings, wherein like reference numerals designate identical or corresponding parts throughout the several views, FIGS. 1A and 1B illustrate an embodiment of the present invention. FIG. 1A is a schematic drawing illustrating a color image forming apparatus in which four image forming sections are arranged side by side in a line. FIG. 1B is a schematic drawing illustrating an exemplary construction of one of the image forming sections in the color image forming apparatus.

In the color image forming apparatus illustrated in FIG. 1A, four image forming sections 1B, 1C, 1M and 1Y are disposed in series and a transfer sheet conveying belt 14 which conveys a transfer sheet to the four image forming sections is arranged. FIG. 1B illustrates a structure of the black image forming section 1B as one of the image forming sections in the color image forming apparatus. The black image forming section 1B is identical to other image forming sections of cyan 1C, magenta 1M and yellow 1Y both in structure and performance unless otherwise specified.

Referring to FIGS. 1A and 1B, when an image forming operation is started, a surface of a photoconductive element 10B as an electrostatic latent image bearing member disposed in the black image forming section 1B is uniformly charged by a charging roller 11B. A desired electrostatic latent image is formed on the surface of the charged photoconductive element 10B with an exposing light 12B irradiated from an optical writing device (not shown). The electrostatic latent image is developed into a visible toner image with black toner (B) in a developing device 13B. The same image forming operation as in the black image forming section 1B is performed with a predetermined time lag in the cyan image forming section 1C, the magenta imaging forming section 1M and the yellow image forming section 1Y, and a toner image of each color of cyan (C), magenta (M), yellow (Y) is formed on a surface of respective photoconductive elements 10C, 10M and 10Y In back surface side of the transfer sheet conveying belt 14, transfer brushes 15B, 15C, 15M and 15Y are provided opposing the respective photoconductive elements 10B, 10C, 10M and 10Y of each image forming section so as to transfer the toner image formed on each of the photoconductive elements 10B, 10C, 10M and 10Y. By applying a predetermined transfer bias to the transfer brushes 15B, 15C, 15M and 15Y, the toner image of each image forming section 1B, 1C, 1M and 1Y is transferred onto a transfer sheet carried on the transfer sheet conveying belt 14 one after another being superimposed on each other. The transfer sheet having the transferred toner image is conveyed to a fixing device (not shown) where the toner image is fixed on the transfer sheet by being heated and pressed, and the full color image is obtained. Residual toner remaining on the surface of the photoconductive elements 10B, 10C, 10M and 10Y after the toner image has been transferred is removed by a cleaning blade (17B) and a cleaning brush roller (18B) of cleaning devices 16B, 16C, 16M and 16Y The removed toner is conveyed to a used toner container (not shown) by a used toner conveying screw (19B).

According to an embodiment of the present invention, lubricant applying devices 30B, 30C, 30M and 30Y are arranged at each image forming section 1B, 1C, 1M and 1Y in the image forming apparatus constructed and operating as described above. According to the exemplary construction illustrated in FIGS. 1A and 1B, the lubricant applying devices 30B, 30C, 30M and 30Y are located between the cleaning devices 16B, 16C, 16M and 16Y and the charging rollers 11B, 11C, 11M and 11Y Referring to the black image forming section 1B, the lubricant applying device 30B includes a lubricant 31B, a holder 32B and a pressurizing spring 33B as illustrated in FIG. 1B. The holder 32B and the lubricant 31B are pressed with a predetermined pressure against the rotatable photoconductive element 10B by the pressurizing spring 33B. A surface of the lubricant 31B is scraped and the scraped lubricant is applied to the surface of the photoconductive element 10B to form a layer of the lubricant on the surface of the photoconductive element 10B.

Figure 2B:
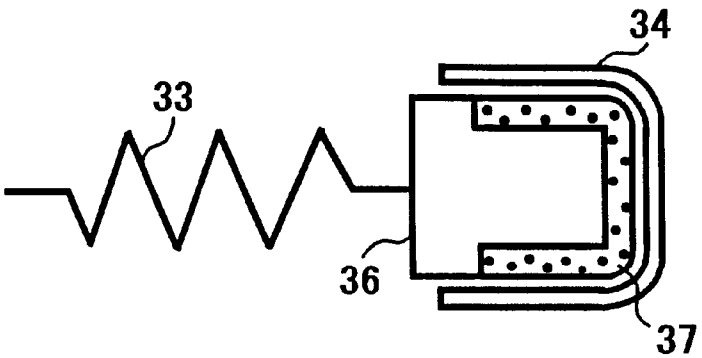
FIGS. 2A and 2B are schematic drawings illustrating an exemplary construction of a lubricant applying device provided in each image forming section of the image forming apparatus in FIGS. 1A and 1B.
Figure 2A:
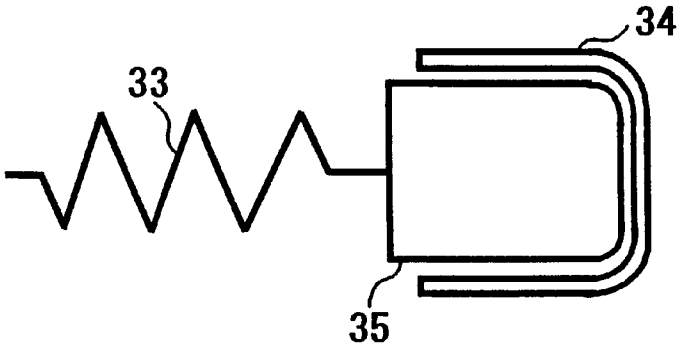

As a lubricant, a solid or a sheet-formed material having lubricating properties may be used. To make a sheet-formed lubricant 34 abut on a photoconductive element, the sheet-formed lubricant 34 may be fixed to a holder 35 by an adhesive double coated tape or the like as illustrated in FIG. 2A, or an elastic element, such as a sponge 37, may be inserted between the sheet-formed lubricant 34 and a holder 36 to uniformly apply an abuting pressure so that the lubricant uniformly abuts on a photoconductive element, as illustrated in FIG. 2B, thereby preventing an uneven abutment.

In an image forming apparatus in which each image forming section 1B, 1C, 1M and 1Y for black, cyan, magenta and yellow is disposed respectively side by side in a line as illustrated in FIG. 1A, the pressurizing springs 33B, 33C, 33M and 33Y used to pressurize the lubricants 31B, 31C, 31M and 31Y of the lubricant applying devices 30B, 30C, 30M and 30Y provided in each image forming section 1B, 1C, 1M and 1Y are arranged such that the pressurizing force of the image forming sections decrease in the order of the yellow, magenta, cyan and black such that the pressing force is largest in the image forming section of yellow and is smallest in that of black. Therefore, sufficient amount of the lubricant is supplied even though a force to remove the lubricant applied to each photoconductive element is increased in the order of the location of the image forming section, i.e., in the order of the image forming section located at an upstream to a downstream in the moving direction of the transfer sheet conveying belt 14 such that the force is largest at the downstream and smallest at the upstream. Inconvenience due to an excess supply of a lubricant may not be caused because appropriate amount of supply of a lubricant can be set according to an image forming condition.

Figure 3:
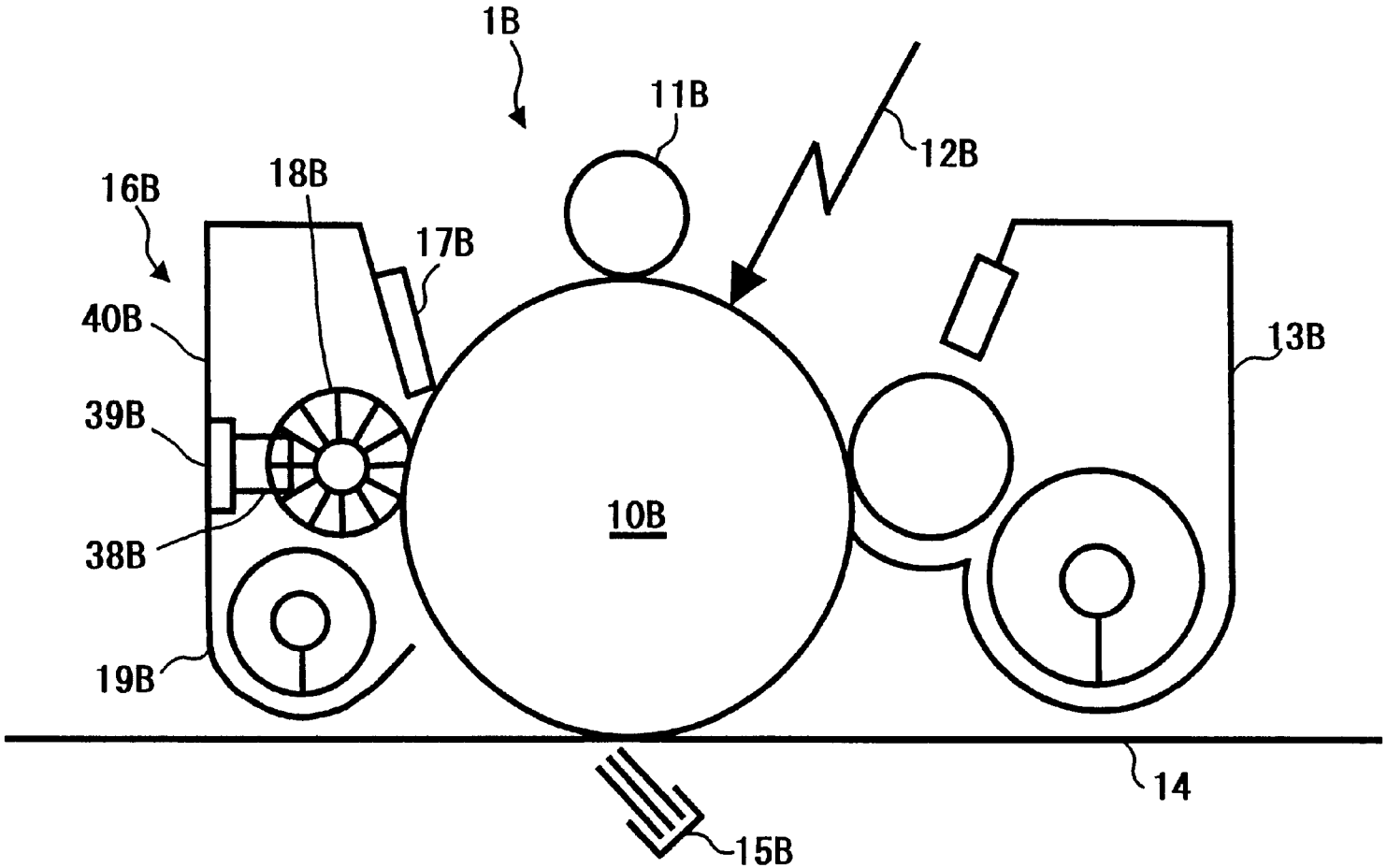
FIG. 3 is a schematic drawing illustrating a structure of one image forming section according to another embodiment of the present invention.
Figure 10:
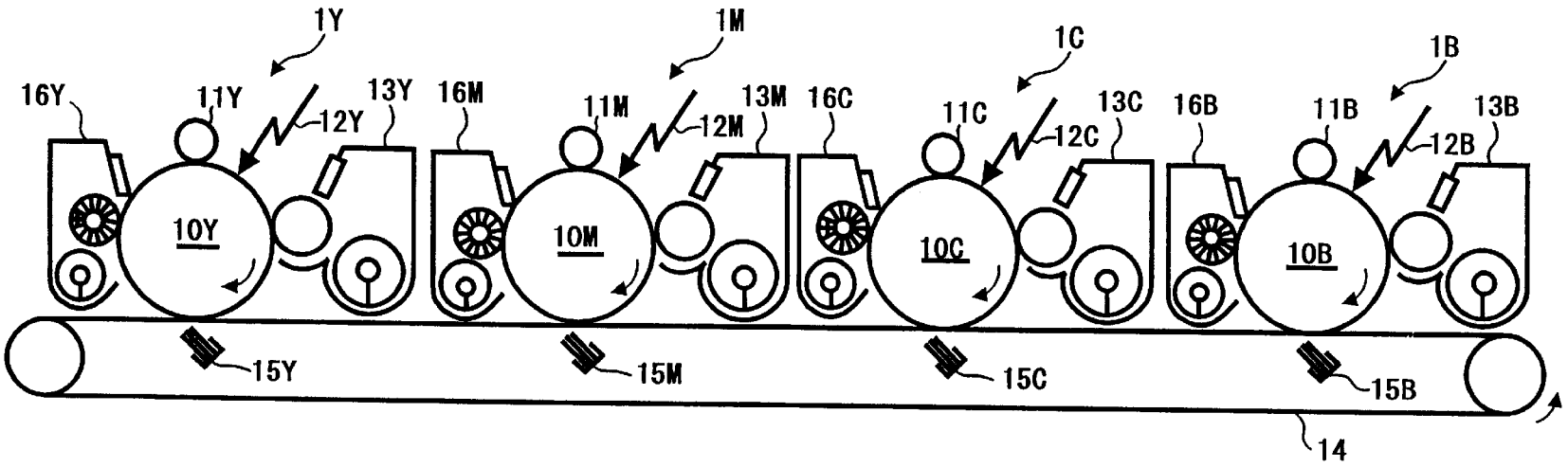
FIG. 10 PRIOR ART
FIG. 10 is a schematic drawing illustrating an exemplary construction of a tandem color image forming apparatus in the art.
Figure 11:
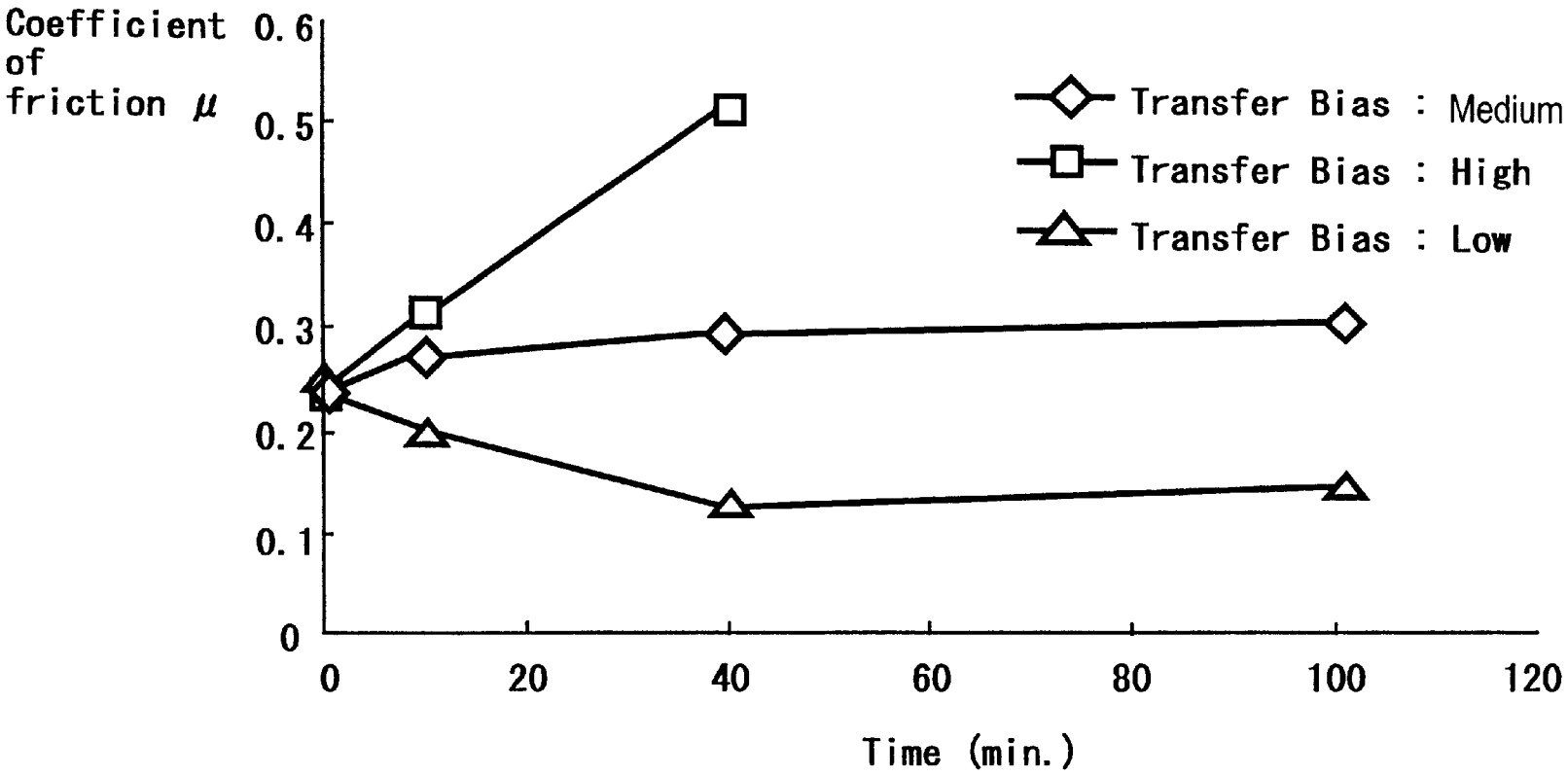
FIG. 11 is a graph explaining a change in an amount of a removed lubricant over a lapse of time according to a different voltage level of a transfer bias. A coefficient of friction on a photoconductive element is measured as substitutive characteristics of an amount of a lubricant on a surface of the photoconductive element.

Another embodiment of the present invention will now be described. FIG. 3 is a schematic drawing illustrating a structure of one image forming section out of four image forming sections of an image forming apparatus constructed similar to that illustrated in FIG. 10. FIG. 3 illustrates a structure of black image forming section 11B as an example. The black image forming section 1B is identical to other image forming sections of cyan, magenta and yellow both in structure and performance unless otherwise specified. According to the image forming section 1B illustrated in FIG. 3, a lubricant applying device is disposed in the cleaning device 16B. A lubricant 38B is provided so as to abut on the cleaning brush roller 18B. The lubricant (or lubricant applicator) 38B is scraped by the cleaning brush roller 18B,and the scraped lubricant adheres to a surface of the cleaning brush roller 18B. The lubricant adhered to the cleaning brush roller 181B is transferred to a surface of the photoconductive element 10B when the cleaning brush roller 188B abuts on the photoconductive element 10B, and then a layer of the lubricant is formed on the surface of the photoconductive element 10B.

Figure 4:
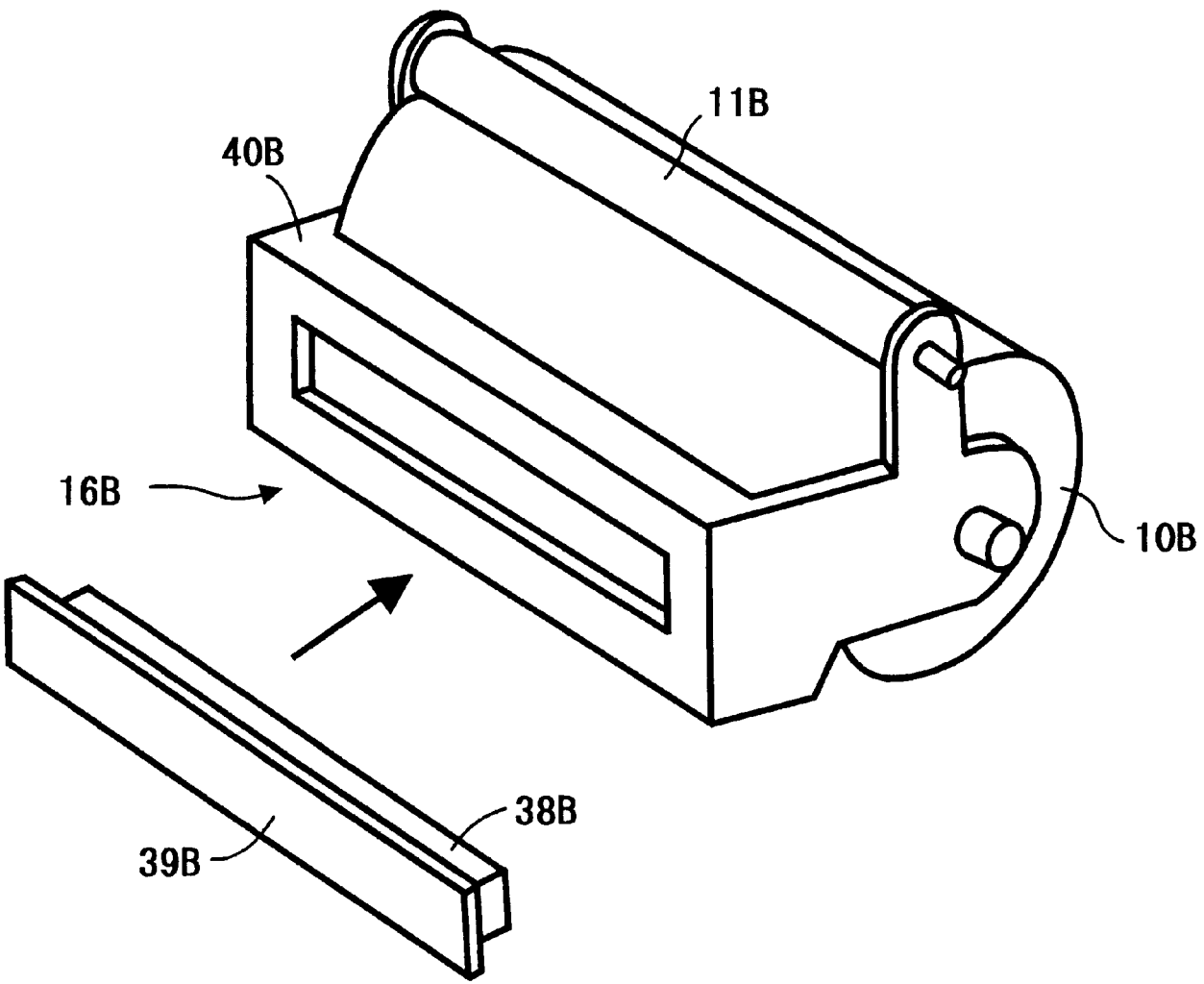
FIG. 4 is a schematic perspective view illustrating the image forming section with the lubricant applying device detached.

FIG. 4 is a schematic perspective view illustrating the image forming section in FIG. 3 with the lubricant applying device detached. A holder 39B holding the lubricant 38B is constructed separately from a casing 40B, which includes the photoconductive element 10B, the charging roller 11B and the cleaning device 16B. The holder 39B is configured to be fixed to the casing 40B by screws, snap fits or the like.

Figure 5:
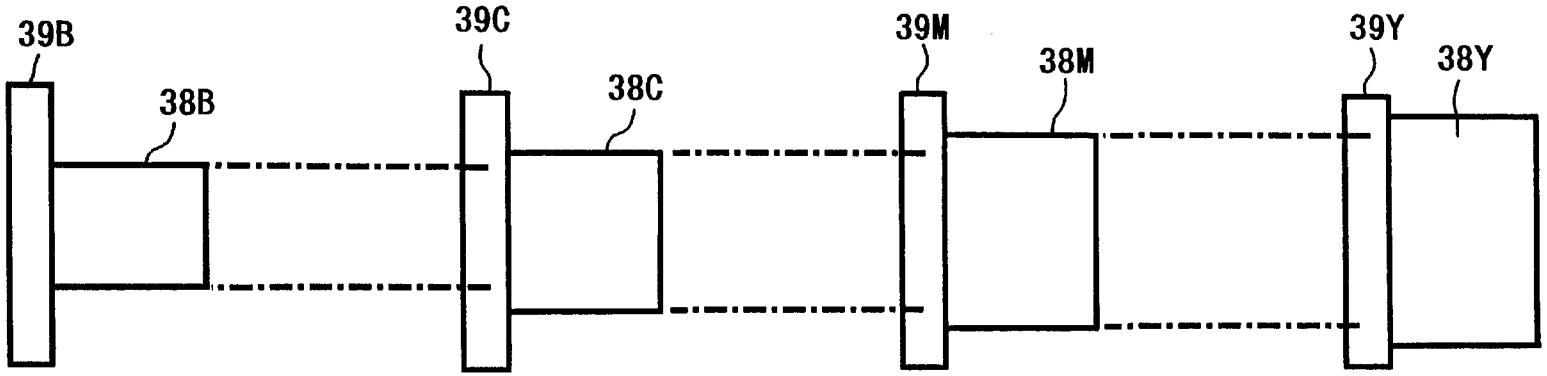
FIG. 5 is a schematic drawing illustrating an example of a shape of a lubricant holder and a lubricant in an image forming section of each color.

FIG. 5 is a schematic drawing illustrating an example of a shape of a lubricant holder and a lubricant in an image forming section of each color when the image forming section illustrated in FIG. 3 is applied to four image forming sections of a color image forming apparatus. When the image forming sections are disposed in order of that of black, cyan, magenta and yellow from an upstream to a downstream in a moving direction of a transfer sheet conveying belt, the lubricants 38Y, 38M, 38C and 38B, which are held by holders 39Y, 39M, 39C and 39B respectively, are configured such that a width of a surface of each lubricant abutting on respective brush roller is decreased in order of the lubricant of yellow, magenta, cyan and black image forming sections such that the width is largest in the image forming section of yellow and is smallest in that of black. Therefore, an amount of supply of a lubricant to a photoconductive element can be increased in order of the image forming section from the upstream to the downstream in the moving direction of the transfer sheet conveying belt such that the amount of supply of a lubricant is largest downstream and smallest upstream.

Figure 6:
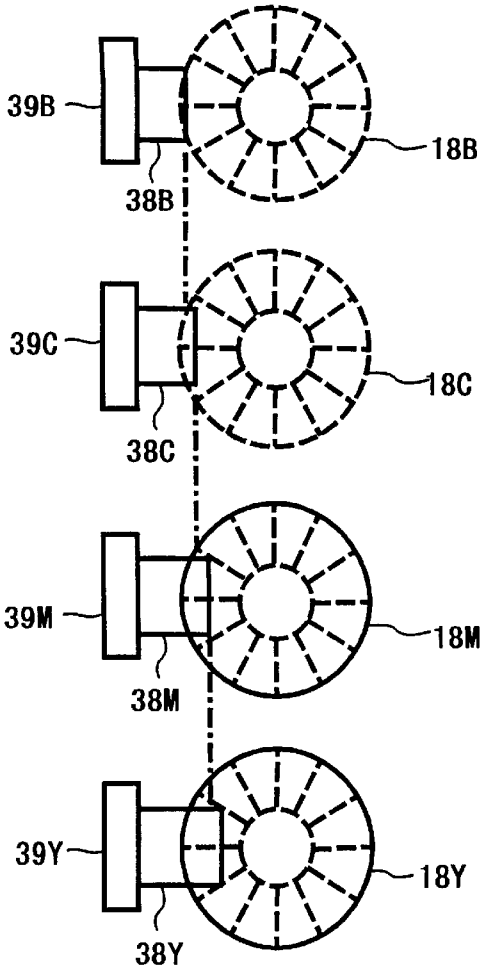
FIG. 6 is a schematic drawing illustrating a length of a lubricant bitten or contacted by a cleaning brush roller in an image forming section of each color according to another embodiment of the present invention.

FIG. 6 is a schematic drawing, according to another embodiment of the present invention, illustrating an amount of a lubricant bitten by a cleaning brush roller in an image forming section of each color when the image forming section illustrated in FIG. 3 is applied to four image forming sections of a color image forming apparatus. The term "bitten" is used to refer to the state or degree to which the lubricant contacts or extends within the cleaning brush roller. When the image forming section is disposed in the order of that of black, cyan, magenta and yellow from an upstream to a downstream in a moving direction of a transfer sheet conveying belt, a length of the lubricants 38Y, 38M, 38C and 38B bitten by the respective cleaning brush rollers 18Y, 18M, 18C and 18B is decreased in the order of the image forming section of yellow, magenta, cyan and black such that the length is largest in the image forming section of yellow and is smallest in that of black. By setting a length of a lubricant bitten by a cleaning brush roller, an amount of supply of a lubricant to a photoconductive element can also be increased in order of the image forming section from the upstream to the downstream in the moving direction of the transfer sheet conveying belt such that the amount of supply of lubricant is largest in the image forming section of the downstream and smallest in that of the upstream.

Figure 7:
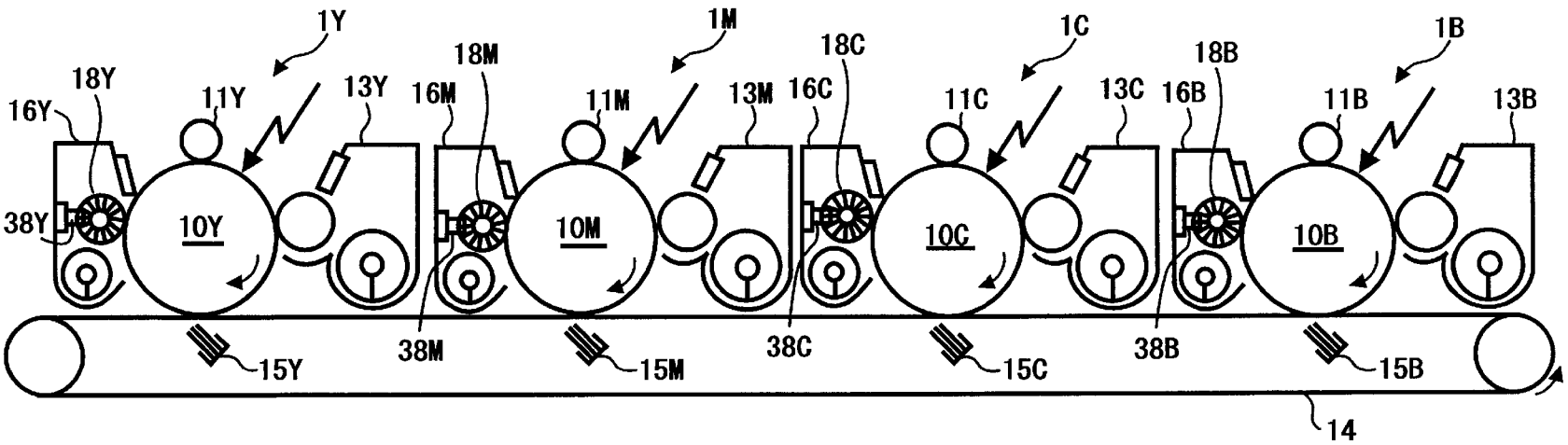
FIG. 7 is a schematic drawing illustrating an exemplary construction of a color image forming apparatus according to another embodiment of the present invention.

FIG. 7 is a schematic drawing illustrating a structure of a color image forming apparatus according to another embodiment of the present invention. Each image forming section 1B, 1C, 1M and 1Y is constructed similar to those in FIG. 3. A lubricant applying device is provided in each cleaning device 16B, 16C, 16M and 16Y. The lubricants 38B, 38C, 38M and 38Y are disposed to abut on the cleaning rollers 18B, 18C, 18M and 18Y respectively. Each image forming section 1B, 1C, 1M and 1Y is constructed almost similar to those in FIG. 3. A lubricant applying device is provided in each cleaning device 16B, 16C, 16M and 16Y and the lubricants 38B, 38C, 38M and 38Y are disposed so as to abut on the cleaning brush rollers 18B, 18C, 18M and 18Y respectively.

According to the embodiment of the present invention, conditions (a width of a lubricant abuts on a cleaning brush roller and a length of a lubricant bitten by a cleaning brush roller) of abutment of the lubricants 38B, 38C, 38M and 38Y on the cleaning brush rollers 18B, 18C, 18M and 18Y are set equal in every image forming section. The cleaning brush rollers 18B, 18C, 18M and 18Y is rotated by a driving source in a body of the image forming apparatus (not shown) and are configured to rotate at a speed such that the speed decreases in order of the brush roller of yellow, magenta, cyan and black such that the brush roller of yellow rotates at the highest speed and that of black rotates at the lowest speed. Therefore, an amount of supply of a lubricant to a photoconductive element can be increased in order of the image forming section from the upstream to the downstream in the moving direction of the transfer belt 14 such that the amount of supply of a lubricant is the largest at the downstream and is smallest at the upstream because the cleaning brush roller of the image forming section which is disposed in the downstream rotates at a higher speed.

Figure 8:
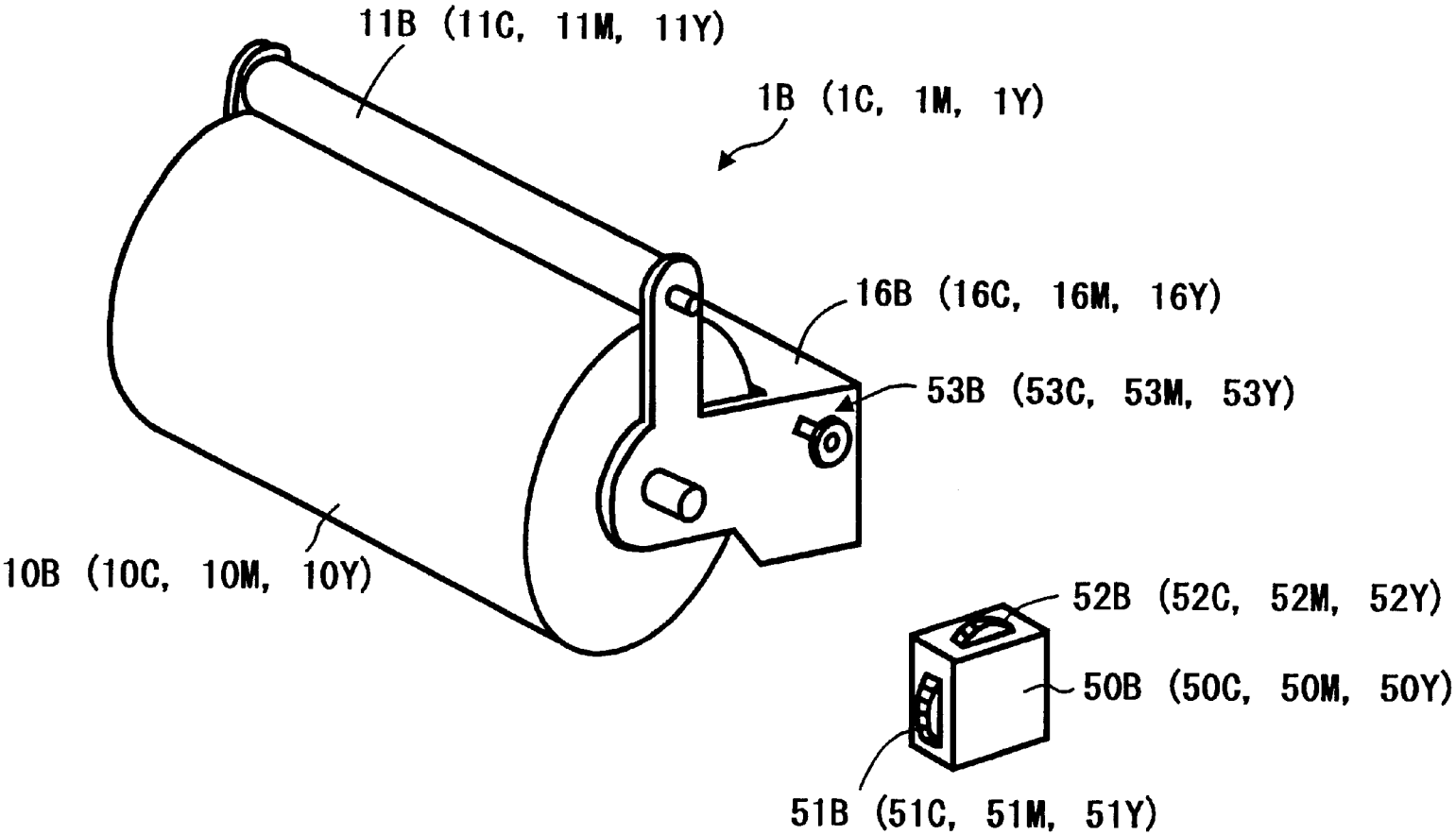
FIG. 8 is a schematic perspective view illustrating an image forming section configured to differentiate a rotating speed of a cleaning brush roller.
Figure 9:
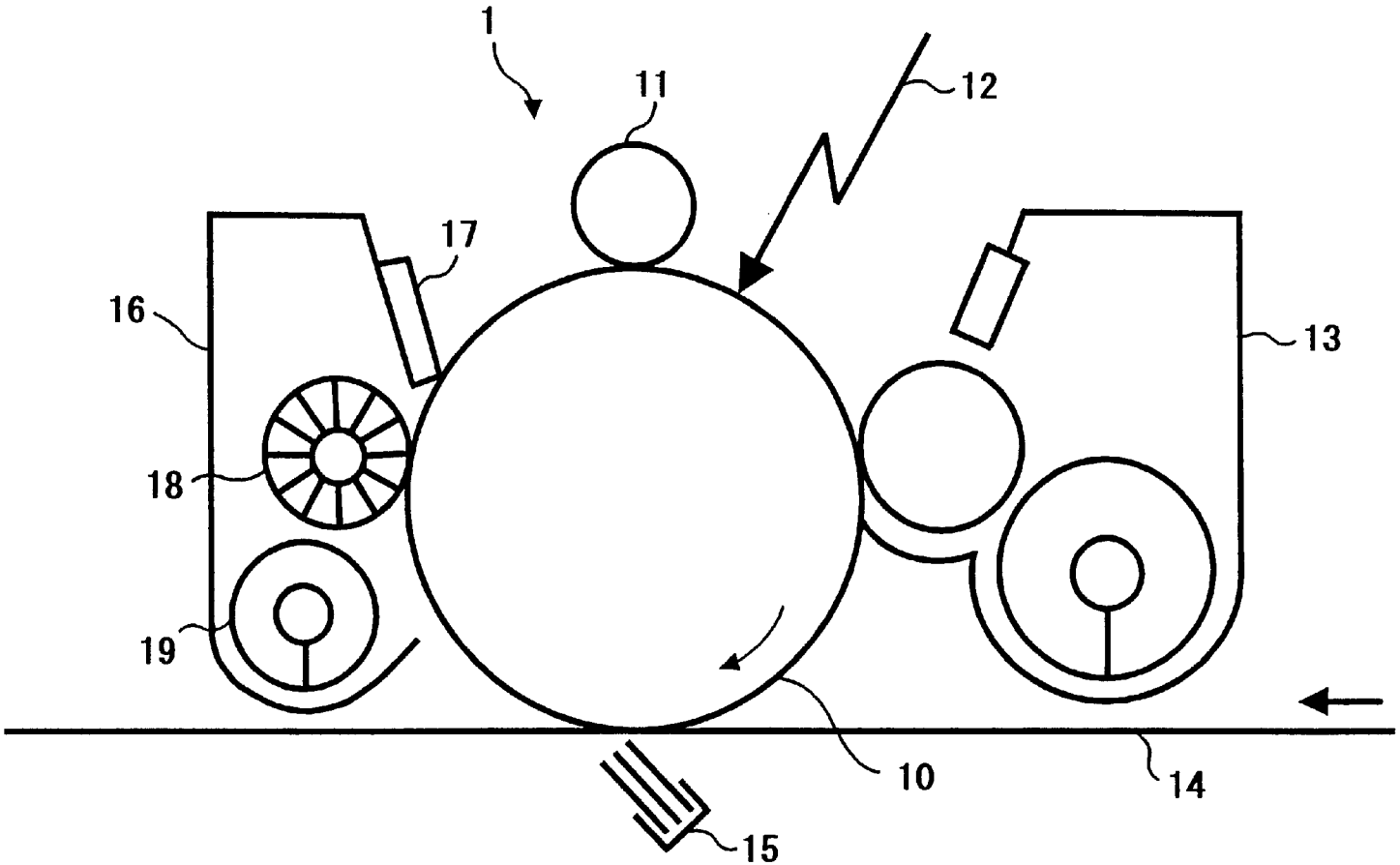
FIG. 9 PRIOR ART
FIG. 9 is a schematic drawing illustrating an exemplary construction of an image forming section of an electrophotographic image forming apparatus in the art.

FIG. 8 is a schematic perspective view illustrating an exemplary construction of an image forming section that differentiates a rotating speed of a cleaning brush roller of each image forming section in the color image forming apparatus in FIG. 7. According to the embodiment of the present invention, transfer devices 50B (50C, 50M and 50Y) are separately constructed that include a plurality of gears 51B (51C, 51M and 51Y) and 52B (52C, 52M and 52Y) to transfer a driving force received from a driving source in a body of an image forming apparatus (not shown) to cleaning brush rollers of the cleaning devices 16B (16C, 16M and 16Y) in the image forming sections 1B (1C, 1M and 1Y). The transfer devices 50B (50C, 50M and 50Y) are provided to the image forming sections 1B (1C,1M and 1Y). The driving force transferred from drive intake gear 51B (51C, 51M and 51Y) is transferred via the driving gears 52B (52C, 52M and 52Y) to brush roller gears 53B (53C, 53M and 53Y) that are provided integrally with the cleaning brush rollers in the cleaning devices 16B (16C, 16M and 16Y).

When the construction illustrated in FIG. 8 is applied to each image forming section illustrated in FIG. 7, each transfer device 50Y, 50M, 50C and SOB is configured such that the rotating speed of the cleaning brush rollers 18Y, 18M, 18C and 18B decreases in the order of these of yellow, magenta, cyan and black such that the brush roller of yellow rotates at the highest speed and that of black rotates at the lowest speed. When a driving force is transferred to the cleaning brush rollers 18B, 18C, 18M and 18Y of the cleaning devices 16B, 16C, 16M and 16Y in each of the image forming sections 1B, 1C, 1M and 1Y, a driving force from a driving source in a body of the apparatus can be transferred to each of the transfer devices 50B, 50C, 50M and 50Y at the same speed. Therefore, a construction of a driving device in the body of the apparatus does not need to be modified for each image forming section. A required rotating speed may be obtained when a driving force is transferred to each transfer devices 50B, 50C, 50M and 50Y from the developing devices 13B, 13C, 13M and 13Y of the respective image forming sections, which reduces the number of transferring points for transferring the driving force from the body of the image forming apparatus to the image forming sections 1B, 1C, 1M and 1Y Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 11-204512, filed on Jul. 19, 1999, and the entire contents thereof are herein incorporated by reference.

What is claimed as new and is desired to be secured by Letters Patent of the United States is:

1. An image forming apparatus, comprising:

a plurality of image forming sections disposed in series in close proximity to or contacting a transfer sheet conveying belt spanned rotatively around rollers, each of said plurality of image forming sections including:

an electrostatic latent image bearing member configured to form an electrostatic latent image on a surface thereof;

a charging device configured to uniformly charge said electrostatic latent image bearing member;

a developing device configured to develop said electrostatic latent image formed on said electrostatic latent image bearing member into a visible image; and a cleaning device configured to remove developer adhered to said electrostatic latent image bearing member;

wherein, a lubricant is supplied to said surface of said electrostatic latent image bearing member to suppress an abrasion of said electrostatic latent image bearing member and an amount of supply of said lubricant is set such that at least one of said plurality of image forming sections is differentiated from other of said plurality of image forming sections.

2. The image forming apparatus according to claim 1, wherein:

said amount of supply of said lubricant is set to increase in order of said image forming section from an upstream to a downstream in a moving direction of said transfer sheet conveying belt.

3. The image forming apparatus according to claim 1, wherein:

said lubricant is supplied to said surface of said electrostatic latent image bearing member by applying a force to press said lubricant against said electrostatic latent image bearing member, and the force is set larger in order of said image forming section from an upstream to a downstream in a moving direction of said transfer sheet conveying belt.

4. The image forming apparatus according to claim 1, wherein:

each of said plurality of image forming sections includes a cleaning brush roller configured such that said cleaning brush roller abuts on said electrostatic latent image bearing member while said lubricant is abutting on said cleaning brush roller so that said lubricant is supplied to said electrostatic latent image bearing member through said cleaning brush roller, and said amount of supply of said lubricant is defined by abutting conditions of said lubricant on said cleaning brush roller.

5. The image forming apparatus according to claim 4, wherein:

said amount of supply of said lubricant is defined by one of a width of said lubricant abutting on said cleaning brush roller and a length of said lubricant bitten by said cleaning brush roller, and said width and said length are set to increase in order of said image forming section from an upstream to a downstream in a moving direction of said transfer sheet conveying belt.

6. The image forming apparatus according to claim 1, wherein:

each of said plurality of image forming sections includes a cleaning brush roller configured such that said cleaning brush roller abuts on said electrostatic latent image bearing member while said lubricant is abutting on said cleaning brush roller so that said lubricant is supplied to said electrostatic latent image bearing member through said cleaning brush roller, and said amount of supply of said lubricant is defined by a rotating speed of said cleaning brush roller, and said cleaning brush roller is configured such that said rotating speed increases in order of said image forming section from an upstream to a downstream in a moving direction of said transfer sheet conveying belt.

7. The image forming apparatus according to claim 6, wherein:

each of said plurality of image forming sections includes a transfer device to transfer a driving force to said cleaning brush roller, and a driving module configured to rotate said cleaning brush roller at a higher speed in order of said image forming section from an upstream to a downstream in a moving direction of said transfer sheet conveying belt.

8. An image forming apparatus, comprising:

a plurality of image forming sections disposed in series in close proximity to or contacting a transfer sheet conveying belt spanned rotatively around rollers, each of said plurality of image forming sections including:

an electrostatic latent image bearing member configured to form an electrostatic latent image on a surface thereof;

means for uniformly charging said electrostatic latent image bearing member;

means for developing said electrostatic latent image formed on said electrostatic latent image bearing member into a visible image; and means for removing developer adhered to said electrostatic latent image bearing member;

wherein, a lubricant is supplied to said surface of said electrostatic latent image bearing member to suppress an abrasion of said electrostatic latent image bearing member and an amount of supply of said lubricant is set such that at least one of said plurality of image forming sections is differentiated from other of said plurality of image forming sections.

9. The image forming apparatus according to claim 8, wherein:

said amount of supply of said lubricant is set to increase in order of said image forming section from an upstream to a downstream in a moving direction of said transfer sheet conveying belt.

10. The image forming apparatus according to claim 8, wherein:

said lubricant is supplied to said surface of said electrostatic latent image bearing member by applying a force to press said lubricant against said electrostatic latent image bearing member, and the force is set larger in order of said image forming section from an upstream to a downstream in a moving direction of said transfer sheet conveying belt.

11. The image forming apparatus according to claim 8, wherein:

each of said plurality of image forming sections includes means for supplying a lubricant configured such that said means for supplying a lubricant abuts on said electrostatic latent image bearing member while said lubricant is abutting on said means for supplying a lubricant so that said lubricant is supplied to said electrostatic latent image bearing member through said means for supplying a lubricant, and said amount of supply of said lubricant is defined by abutting conditions of said lubricant on said means for supplying a lubricant.

12. The image forming apparatus according to claim 11 wherein:

said amount of supply of said lubricant is defined by one of a width of said lubricant abutting on said means for supplying a lubricant and a length of said lubricant bitten by said means for supplying a lubricant, and said width and said length are set to increase in order of said image forming section from an upstream to a downstream in a moving direction of said transfer sheet conveying belt.

13. The image forming apparatus according to claim 8, wherein:

each of said plurality of image forming sections includes means for supplying a lubricant configured such that said means for supplying a lubricant abuts on said electrostatic latent image bearing member while said lubricant is abutting on said means for supplying a lubricant so that said lubricant is supplied to said electrostatic latent image bearing member through said means for supplying a lubricant, and said amount of supply of said lubricant is defined by a rotating speed of said means for supplying a lubricant, and said means for supplying a lubricant is configured such that said rotating speed increases in order of said image forming section from an upstream to a downstream in a moving direction of said transfer sheet conveying belt.

14. The image forming apparatus according to claim 13, wherein:

each of said plurality of image forming sections includes means for transferring a driving force to said means for supplying a lubricant, and means for transferring a driving force configured to rotate said means for supplying a lubricant at a higher speed in order of said image forming section from an upstream to a downstream in a moving direction of said transfer sheet conveying belt.

* * * * *